US012782094B2

(12) United States Patent
Wandzik

(10) Patent No.: US 12,782,094 B2
(45) Date of Patent: Nov. 3, 2026

(54) HOLDING DEVICE FOR PIECES OF FIREWORKS, MORE PARTICULAR SKYROCKETS

(71) Applicant: Thomas Wandzik, Munich (DE)

(72) Inventor: Thomas Wandzik, Munich (DE)

( * ) Notice: Subject to any disclaimer, the term of this patent is extended or adjusted under 35 U.S.C. 154(b) by 76 days.

(21) Appl. No.: 18/708,293

(22) PCT Filed: Aug. 30, 2022

(86) PCT No.: PCT/DE2022/100644
§ 371 (c)(1),
(2) Date: May 8, 2024

(87) PCT Pub. No.: WO2023/083402
PCT Pub. Date: May 19, 2023

(65) Prior Publication Data
US 2025/0164221 A1 May 22, 2025

(30) Foreign Application Priority Data
Nov. 9, 2021 (DE) ..... 10 2021 129 098.8

(51) Int. Cl.
*F42B 4/20* (2006.01)

(52) U.S. Cl.
CPC ..... *F42B 4/20* (2013.01)

(58) Field of Classification Search
CPC ..... F42B 4/20
See application file for complete search history.

(56) References Cited

U.S. PATENT DOCUMENTS

| | | | | |
|---|---|---|---|---|
| 1,776,353 A | | 9/1930 | Dunbar et al. | |
| 1,776,354 A | | 9/1930 | Edmands | |
| 1,823,378 A | * | 9/1931 | Scardone | F42B 4/02 102/357 |
| 3,719,147 A | * | 3/1973 | Toporex | F42B 4/20 102/343 |
| 4,025,289 A | * | 5/1977 | Duncan | F42B 4/20 102/343 |
| 4,222,306 A | * | 9/1980 | Maury | F42B 5/035 102/342 |
| 5,429,053 A | | 7/1995 | Walker | |
| 5,739,462 A | * | 4/1998 | Poor | F41B 11/51 102/440 |

(Continued)

FOREIGN PATENT DOCUMENTS

| | | |
|---|---|---|
| AT | 10811 | 10/2009 |
| CH | 281662 | 3/1952 |

(Continued)

OTHER PUBLICATIONS

Blackboxx Fireworks, Blackboxx Starbase —der Profi-Raketenständer (Tutorial), Youtube, Dec. 2019, https://www.youtube.com/watch?v=EfZ-Qrh3kaw.

*Primary Examiner* — Michelle Clement
(74) *Attorney, Agent, or Firm* — Pandiscio & Pandiscio

(57) ABSTRACT

The invention relates to a holding device for pieces of fireworks, more particularly skyrockets, comprising an engagement part (112), the engagement part (112) and/or a top part (114) that is or can be connected thereto being designed to accommodate a piece of fireworks (118) to be fired. The engagement part (112) is designed to fasten the holding device to the top surface of a carrier device (102).

12 Claims, 9 Drawing Sheets

(56) References Cited

U.S. PATENT DOCUMENTS

| | | | | |
|---|---|---|---|---|
| 5,979,329 | A * | 11/1999 | Collar | F42B 4/02 102/361 |
| 7,007,584 | B2 * | 3/2006 | Caballer Barat | F42B 4/20 89/1.816 |
| 7,011,220 | B2 * | 3/2006 | Deye | F42B 4/20 211/60.1 |
| 7,100,512 | B2 * | 9/2006 | Monetti | C06C 5/06 102/275.1 |
| 9,010,247 | B2 * | 4/2015 | Caballer Barat | F42B 4/02 102/357 |
| 9,739,577 | B2 * | 8/2017 | Zhang | F42B 3/103 |
| 10,393,483 | B2 * | 8/2019 | Lu | F42B 4/04 |
| 11,536,545 | B2 * | 12/2022 | Monetti | H01R 12/714 |
| 11,555,675 | B2 * | 1/2023 | Gauvin | F42B 4/00 |
| 11,591,111 | B2 * | 2/2023 | Powers | B64G 1/002 |
| 11,692,799 | B1 * | 7/2023 | Tasick | F42B 4/24 102/335 |
| 2005/0092622 | A1 * | 5/2005 | Whitley | F42B 4/20 206/3 |
| 2005/0204911 | A1 * | 9/2005 | Barat | F42B 3/26 89/1.816 |
| 2007/0214948 | A1 * | 9/2007 | Centrone | F41A 19/59 86/20.1 |
| 2011/0017088 | A1 | 1/2011 | Steadmand, Sr. | |
| 2024/0377170 | A1 * | 11/2024 | Gilfillan | F42B 4/20 |

FOREIGN PATENT DOCUMENTS

| | | |
|---|---|---|
| CN | 2919182 | 7/2007 |
| DE | 102005013093 | 11/2005 |
| DE | 202013003025 | 5/2013 |
| DE | 202013003075 | 7/2013 |
| JP | H08-145600 | 6/1996 |

* cited by examiner

HOLDING DEVICE FOR PIECES OF FIREWORKS, MORE PARTICULAR SKYROCKETS

REFERENCE TO PENDING PRIOR PATENT APPLICATIONS

This patent application is a 371 national stage entry of pending prior International (PCT) Patent Application No. PCT/DE2022/100644, filed 30 Aug. 2022 by Thomas Wandzik for HOLDING DEVICE FOR PIECES OF FIREWORKS, MORE PARTICULAR SKYROCKETS, which patent application, in turn, claims benefit of German Patent Application No. DE 10 2021 129 098.8, filed 9 Nov. 2021.

The two (2) above-identified patent applications are hereby incorporated herein by reference.

FIELD OF THE INVENTION

The invention relates to a holding device for articles of fireworks, in particular for skyrockets. However, the holding device may be configured for virtually any other variants of pyrotechnic articles, such as bomb tubes and pyrotechnic pinwheels (also known as whirligigs or spinners).

BACKGROUND OF THE INVENTION

It is common practice to launch skyrockets or bomb tubes from auxiliary devices, for example by means of free-standing glass bottles or glass bottles held in crates or from street gullies. In the absence of such makeshift devices, skyrockets are also launched from the hand or are stuck into lawns or snow piles for this purpose. Furthermore, pyrotechnic pinwheels are attached to house walls and trees and are burned down while held in this fashion.

All of these methods are susceptible to malfunctions and faults. In particular, they may present a risk for the individuals executing these actions and for bystanders. For example, glass bottles used for this purpose are easily blown over due to their small base or may topple over due to uneven weight distribution of the articles of fireworks or may lack stability due to adverse ground conditions. For this reason, one frequently reads reports of damage to humans, animals, objects, and trees after fireworks are lit. There is statistical evidence of the fire risk due to uncontrolled or incorrectly used articles of fireworks.

Based on this prior art, it is the object of the invention to create a holding device for articles of fireworks, in particular for skyrockets, that reduces the risk of injury when lighting fireworks and can be manufactured easily and inexpensively.

SUMMARY OF THE INVENTION

The invention achieves this object by means of the characteristics of claim 1. Further embodiments of the invention are revealed in the dependent claims.

The holding device according to the invention comprises an engagement part, which in turn is configured for receiving an article of firework to be lit and/or which is connectable or connected to a top part, whereby the top part is configured for receiving an article of firework to be lit. The engagement part according to the invention is configured for mounting the entire holding device on the top side of a sufficiently stable carrier device. In the context of the present specification, "sufficiently stable" is to be understood in the sense that the carrier device must be configured such that it is capable of absorbing the forces occurring during the lighting of the fuse and during the lighting and setting off the article of firework, without the carrier device tilting together with the holding device mounted therein. This mitigates the risk induced by fireworks for individuals in the proximity. In particular, the articles of fireworks that are to be held for burning may be skyrockets, bomb tubes or pyrotechnic pinwheels.

According to an embodiment of the invention, the carrier device may comprise a plurality of parallel, interconnected, vertically oriented tubes whose end faces form the top side of the carrier device. Such a carrier device may be manufactured specifically for the holding device according to the invention.

According to the invention, a fired base body of a firework battery may be used as a carrier device for the holding device, and/or the engagement part of the holding device may be configured such that the engagement part of the holding device can be inserted into the vertically oriented tubes of a base body of a burned-out firework battery, thereby securing the holding device in the carrier device in a sufficiently stable manner.

According to a preferred embodiment, the engagement part comprises a support flange for resting on the top side of the carrier device in the mounted state of the holding device on the carrier device, wherein at least one holding means is provided on a bottom side of the support flange, the means being configured to engage with at least one recess in the top side of the carrier device. The support flange is configured such that its preferably at least sectionally planar bottom side rests on the top side of the carrier device. The at least one holding means thereby engages with at least one recess in the top side of the carrier device, such that the holding device is secured against tilting.

According to an embodiment of the invention, the at least one holding means is configured in a clip-like manner, wherein the at least one holding means comprises at least one clip having two resiliently flexible arms abutting against a respective inner wall of the at least one recess in the mounted state and applying a force thereto, wherein the two force vectors preferably have components directed in opposite directions.

For example, the at least one holding means may be configured such that it engages with two immediately adjacent tubes of the carrier device.

Hereby, the two arms of a holding means embodied as a clip may be configured and arranged such that they apply a force onto inner walls, facing each other, of two immediately adjacent tubes.

As a matter of course, the at least one holding means may also be configured in any other manner that allows to suitably secure the engagement part in the carrier device. For example, a mandrel extending downwards may be provided, on the outer wall of which a plurality of, for example three, spring-like arms are arranged. The mandrel may then engage with a recess, for example with a tube interior.

The at least one holding means may also be embodied as a slightly tapered mandrel, whose diameter in the region underneath the support flange substantially corresponds to the inner diameter of a corresponding recess in the or to the inner diameter of a tube of the carrier device. This variant may be advantageous if the holding device according to the invention is sold together with a firework battery that is used as a carrier device for the holding device after lighting and setting it off. This entire arrangement may then be used for lighting and setting off further articles of fireworks.

According to an embodiment of the invention, the engagement part may comprise a receptacle for an article of firework, in particular for a bomb tube or a pyrotechnic pinwheel. In such an embodiment, the holding device according to the invention does not need an additional part, in particular any top part.

The receptacle may, for example, consist of a mandrel or pin extending vertically upwards, onto which a pyrotechnic pinwheel may be stuck. The pyrotechnic pinwheel may then rotate about the extension formed by the mandrel or pin. The mandrel or pin may also be releasably connected to the remaining engagement part, such that it may be attached as needed.

The receptacle may also consist of a circumferential wall that forms, together with the bottom formed underneath by the top side of the engagement part, a receiving space for receiving a bomb tube. Of course, instead of a circumferential wall, a plurality of upwardly protruding extensions may also be provided, between which the receiving space for a bomb tube is formed in turn. In both cases, the bomb tube may be secured with its longitudinal axis perpendicular to the bottom of the engagement part, such that there is no risk of the bomb tube tipping over when it is lit and the lit article of firework endangering or even injuring people in the vicinity.

According to another embodiment of the invention, the holding device comprises a top part, wherein the top part is connected to the engagement part or is connectable to the engagement part without tools or wherein the top part and the engagement part are connectable by means of a connecting part without tools, preferably releasably. This results in the advantage of a smaller packing volume. When in use, the holding device may be assembled quickly and easily. The releasable connection of the individual parts may also be achieved by means of snap-lock connections, such that a disintegration of the holding device during use is safely avoided.

The connecting part may have a rod-like or tube-like shape and preferably consist of a plurality of elements that can be connected without tools. In particular for holding skyrockets, the connecting part has to be long enough such that the top part of the holding device is at such a height that the guide stick of the skyrocket does not stand up on the ground or on the top side of the carrier device and thereby the skyrocket is not held securely in the holding device.

In particular, the top part may comprise a receptacle for receiving one or more skyrockets. The receptacle for each skyrocket may comprise a tubular receiving part for the guide stick of the respective skyrocket, wherein the tubular receiving part preferably has an inner cross section such that a top part of the skyrocket abuts against the upper end face of the tubular receiving part in the inserted state of the skyrocket.

According to an embodiment, the tubular receiving part may have an upwardly, preferably conically, widening shape, wherein the conical widening is preferably dimensioned such that the upper end of the wall of the tubular receiving part prevents a fuse of an inserted skyrocket from abutting against the outer wall of the tubular receiving part. This facilitates lighting the fuse.

On the outer wall of the tubular receiving part, a windscreen device may be provided, which creates a windscreened region, where the fuse of a skyrocket inserted into the tubular receiving part engages. This may facilitate lighting the fuse under windy conditions.

In an embodiment of the invention, the windscreen device may comprise one or two walls that are preferably pivotable about an axis parallel to the longitudinal axis of the tubular receiving part. These may abut against the outer periphery of the respective tubular receiving part during transport of the holding device and/or the top part and may be pivoted and/or bent outwards for use.

BRIEF DESCRIPTION OF THE DRAWINGS

The invention is explained hereinafter in more detail by means of the exemplary embodiments illustrated in the figures, in which.

DETAILED DESCRIPTION OF THE PREFERRED EMBODIMENTS

Figure 1:
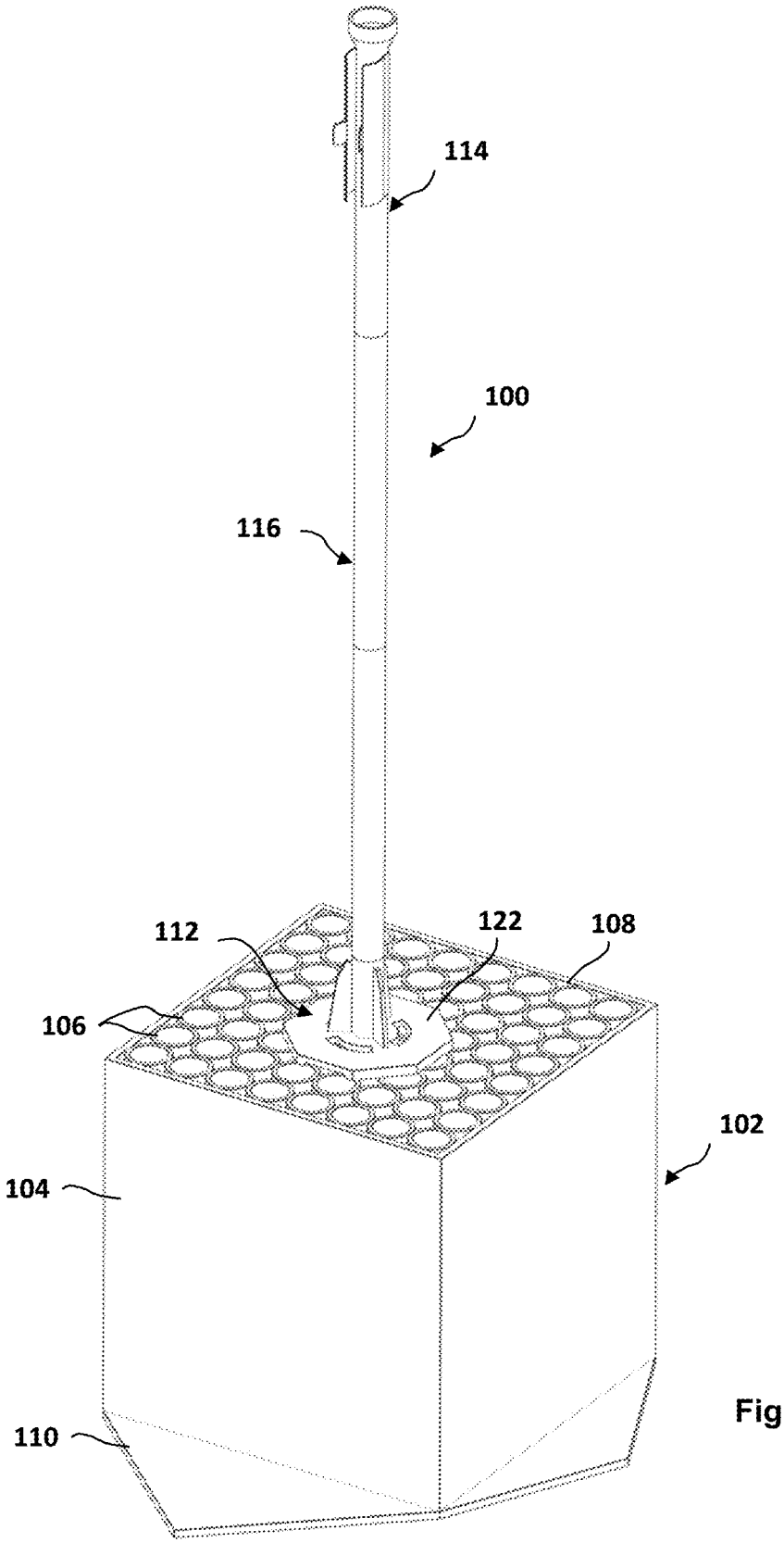
FIG. 1 shows a perspective view of a first embodiment of a holding device inserted into a carrier device according to the invention.

FIG. 1 shows a perspective view of a first embodiment of a holding device 100 for at least one article of firework, the holding device being inserted into a carrier device 102. The carrier device 102 is configured such that sufficient stability is guaranteed for the holding device 100 connected thereto, preferably releasably, for inserting at least one article of firework into the holding device and for lighting and setting off, respectively, of the at least one article of firework. To this end, the carrier device must have a sufficiently large support area and/or sufficiently large dimensions, respectively, between at least three foot or support areas, as well as sufficient weight.

As shown in FIG. 1, in particular, the base body 104 of a burned-out firework battery may be used as a carrier device. Such a base body is typically comprised of vertically arranged, interconnected tubes 106. The longitudinal axes of the tubes 106 are arranged in a matrix-like array-when viewed in a plane perpendicular thereto. The tubes 106 may be held in position by an outer wall 108 surrounding them. Of course, the tubes 106 may be additionally connected, for example glued, at the adjacent contact lines with each other as well as at their contact lines with the wall 108. The lower end face of the tubes 106 may be connected to a bottom wall 110 (or the bottom wall may only be connected with the wall 108 and support the tubes 106 arranged in this cup-like formation). In this case, the bottom wall may form the (substantially planar) support area of the carrier device. As can be seen from FIG. 1, the bottom wall, shown in plan view, may also have larger dimensions than the dimensions of the remaining carrier device. This increases the support area and the stability.

Instead of such a burned-out firework battery, any other device that ensures corresponding stability and comprises one or more suitable recesses on its top surface for receiving and securing the engagement part, as described below, may be used. The use of a burned-out firework battery has the advantage, that further use is found for such a waste product in terms of sustainability. It is not necessary to manufacture and purchase a separate carrier device specifically for this purpose.

The holding device 100 comprises an engagement part 112 in its lower region and a top part 114 in its upper region. As illustrated in FIG. 1, the top part 114 may be connected to the engagement part 112 via a rod-shaped connecting part 116. In particular, the connection between the top part 114 and the connecting part 116 and/or the connection between the engagement part 112 and the connecting part 116 may be releasable, for example pluggable. In order to avoid inadvertent release, this connection may be secured by suitable snap-lock means.

The top part 114 and the engagement part 112 may also be directly connected to each other in an integral manner or connected via a connecting part 116 integrally connected thereto. The releasable connection of the top part 114 and the engagement part 112 (either directly with each other or via a respective releasably connected connecting part 116) has the advantage of a lower packing volume for transport.

According to the invention, a top part 114 does not necessarily have to be connected to the engagement part 112. Rather, the engagement part 112 may already be configured on its top face for holding and securing an article of firework, for example a bomb tube or a pyrotechnic pinwheel. With such variants, not discussed in detail herein, where the holding device merely comprises one correspondingly configured engagement part, an extension vertically extending upwards may be provided at the top of the engagement part, in particular at the top of the support flange of the engagement part described below, on top of which extension an article of firework in form of a pyrotechnic pinwheel may be inserted. This pyrotechnic pinwheel is then rotatably held for burning. In addition, the extension may be configured for connecting with a rod-like connecting part (see above) or with a correspondingly configured top part.

According to a further embodiment, not shown, at its top side, in particular at the top side of the support flange, the engagement part 112 may comprise means for holding and securing, respectively, a bomb tube. This may be a circumferential vertical wall, in the interior of which the bomb tube may be received at least with its lower part. Thereby, the bomb tube is secured against toppling over when it is being burned off. Instead of a circumferential wall, extensions vertically extending upwards may be provided.

Figure 2:
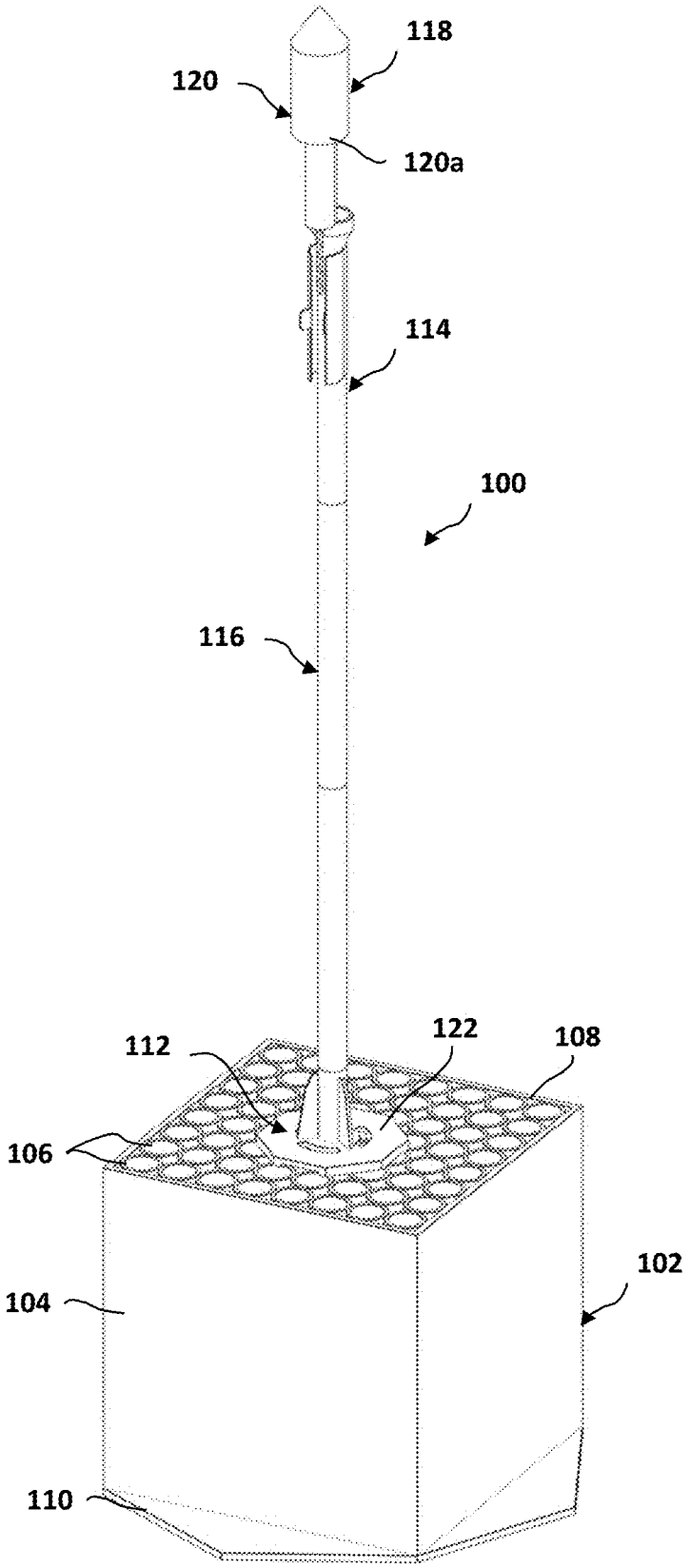
FIG. 2 shows a view as in FIG. 1, but with a skyrocket inserted into the holding device.

FIG. 2 shows a representation of the holding device 100 of FIG. 1 inserted into or mounted onto a carrier device, with an article of firework 118 in form of a skyrocket 120 inserted into and held by the top part 114, respectively. As can be seen from this illustration, both the top part 114 and the connecting part 116 are configured as hollow cylinders, such that the guide stick of the skyrocket 120 engages with these two elements. The top part 114, configured as a tubular receiving part for the guide stick of a skyrocket 120, is dimensioned with respect to its inner diameter such that its upper end face and/or its upper portion forms a stop for the bottom face and/or the lower portion of the head 120*a* of the skyrocket 120. Hereby, the skyrocket 120 is held securely.

As can be seen from FIG. 2, in its upper portion, the top part 114 has a widening, for example conically expanding, portion 114*a*. On one hand, this diameter widening (or the widening of the inner cross section of the top part 114) facilitates insertion of the guide stick of a skyrocket into the holding device. On the other hand, the widening serves to keep the fuse protruding downward at the bottom side of the head 120*a* of the skyrocket 120 away from the outer circumference of the cylindrical region of the top part 114 below the upwardly expanding section. Thereby the fuse is prevented from abutting against the outer periphery of the top part with its lower region, which must be lit. An abutment of the fuse against the outer wall would hinder the lighting and would damage the outer wall of the top part when the fuse is burning, such that the durability of the holding device would be drastically shortened, at least if the holding device is not made of a fireproof material, such as metal, in this region. Thereby the entire device may be made of an environmentally friendly material, such as paperboard, cardboard, wood, or the like. As a matter of course, the entire device or parts thereof may be made of any other material, in particular plastic or metal. Merely resilient members, such as the holding means described below, comprising one or more resiliently flexible elements, for example arms, must be made of a material that is able to maintain its resilient flexibility in the cold and cannot break under deformation within the permissible range, for example of a cold-resistant plastic or of metal.

Figure 3:
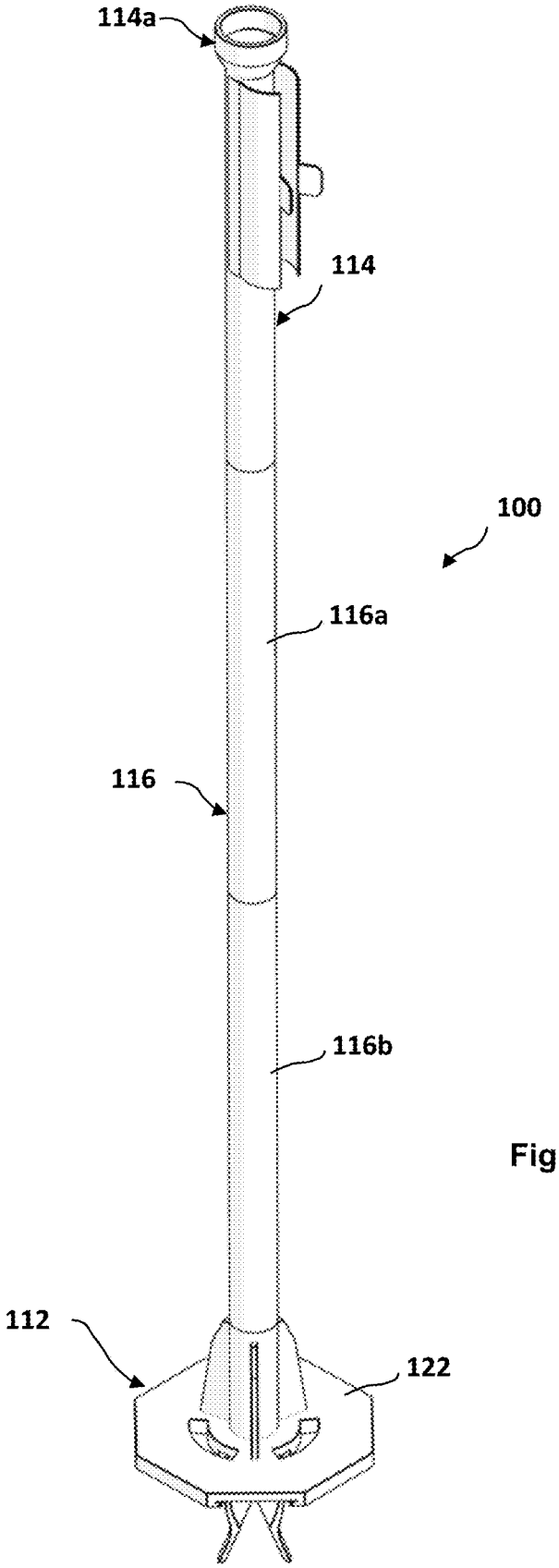
FIG. 3 shows a perspective view of the holding device according to FIGS. 1 and 2 without the carrier device.

FIG. 3 shows a larger perspective view of the holding device 100 according to the embodiment of FIGS. 1 and 2. In particular, in this illustration, the top part 114 and the engagement part 112 are shown in more detail, whereby these two parts are connected via the connecting part 116, which consists of two cylindrical parts 116*a*, 116*b*. As described herein above, the connection may be configured to be pluggable, or pluggable and snap-lockable, respectively. In addition, the connection between the two cylindrical parts 116*a* and 116*b* may be configured to be pluggable, or pluggable and snap-lockable, respectively. The connecting part 116 or the cylindrical parts 116*a*, 116*b* may not need to have a circular cylindrical cross-section. Rather, the cylindrical parts 116*a*, 116*b* may have any desired cross section, for example, also a rectangular cross section. Furthermore, these parts may be hollow cylinders.

The engagement part 112 comprises a support flange 122, as already mentioned above. This support flange, at least in its outer circumferential regions at its underside, may have a planar support surface that rests on top of the carrier device 102 and secures the entire holding device 100 against toppling over. The top of the carrier device 102 may, as shown in FIGS. 1 and 2, be formed by the end faces of the tubes 106, if a burned-out firework battery is used.

Figure 4:
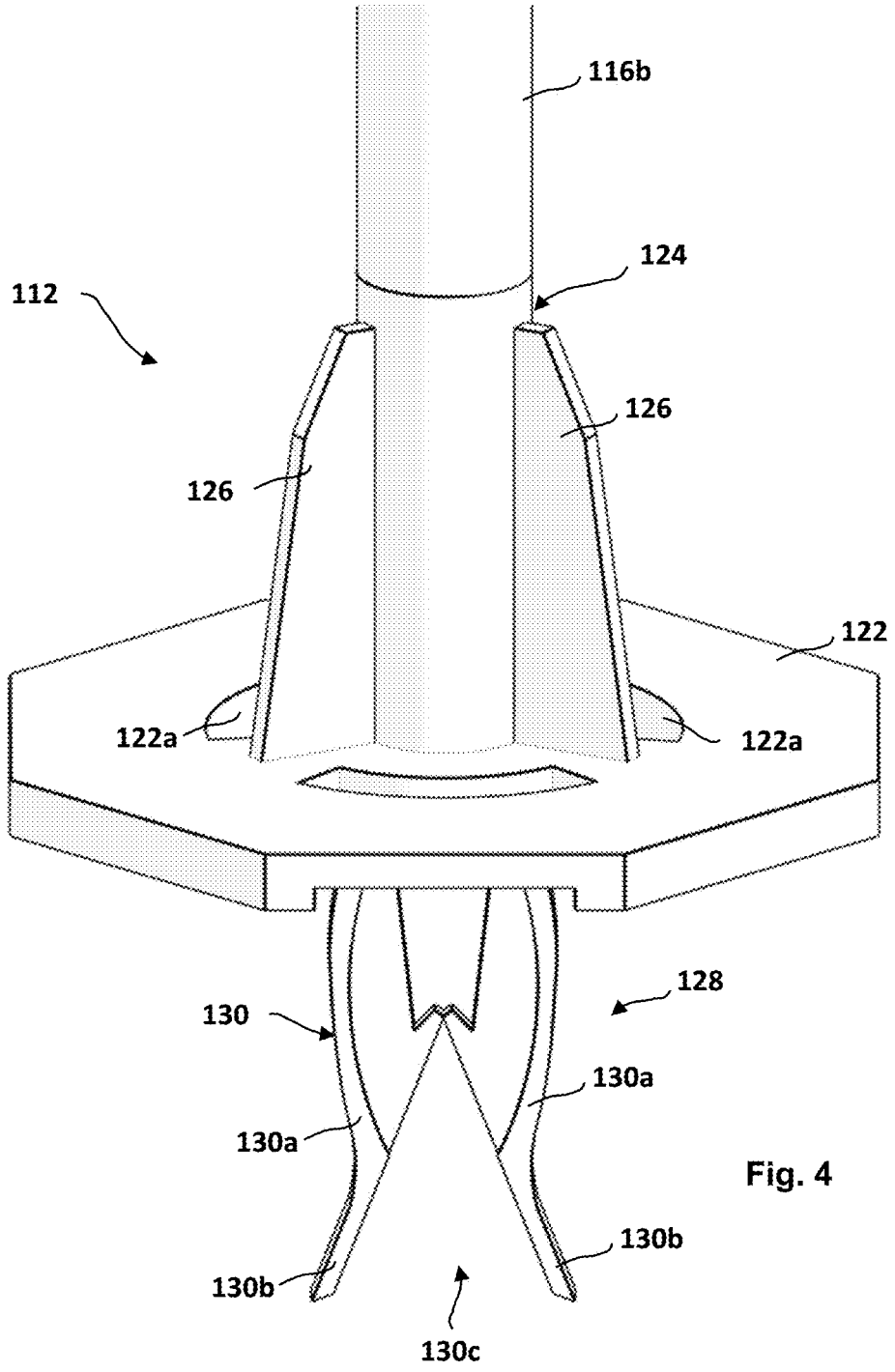
FIG. 4 shows an enlarged partial view of the lower portion of the holding device of FIG. 3.

The engagement part 112 is visible in an enlarged perspective view of FIG. 4. On the top side of the support flange 122, an extension 124 is provided that extends vertically upwards and may be formed integrally with the support flange 122. At its top face, the extension 124 may be configured such that it may be connected to the connecting part 116, in particular to its lower part 116*b*. For example, the extension 124 may be embodied as a hollow cylinder, such that a lower portion of part 116*b* may be inserted into the upper portion of the extension 124. As a matter of course, any other suitable connection that ensures sufficient stability of the entire holding device 100 may be selected as well. On the peripheral side of the extension 124, as shown in FIG. 4, reinforcements 126 may be provided in the form of vertically extending walls, which may preferably have a vertically extending and radially oriented central plane. For example, three such reinforcements may be provided. This reduces the risk of bending or buckling of the extension 124, when forces with a component perpendicular to the longitudinal axis of the holding device 100 are applied onto the upper region of the holding device 100, in particular onto the top part 112.

As already mentioned above, the engagement part 112, in particular the extension 124 and, if applicable, the reinforcements 126 may be configured such that they already form a holding device 100 for an article of firework, for example a pyrotechnic pinwheel. For example, in case of the variant of the engagement part 112 shown in FIG. 4 forming a holding device 100, a pyrotechnic pinwheel may be attached onto the extension 124. When the pinwheel is lit, it may rotate around the extension 124 and the reinforcements 126, in order to achieve the desired effect. For this purpose, the extension 124 may have such a height that there is no risk of the pyrotechnic pinwheel being lifted upwards from the extension 124 when the pinwheel attached thereto burns down.

In a further variant that is not illustrated, the engagement part 122 may be configured such that at least one holding means for a bomb tube is provided on the top side of the support flange 122, which may also comprise a leg support with a slightly larger diameter than the actual bomb tube. These holding means may, for example, be configured as a closed wall, such that a cup-like receptacle for the bomb tube is formed together with the top side of the support flange 122.

Of course, instead of a closed wall vertical extensions, for example in the form of relatively thin walls, may also be provided, which form a (non-closed) space in between, where the bomb tube may be inserted, whereby a bomb tube inserted between the extensions is secured against toppling over by the extensions substantially extending vertically upwards.

As can further be seen from FIG. 4, through holes 122*a* may be formed in the support flange 122, for example provided along a circle. This reduces the cost of materials for the support flange 122 and thus the engagement part 112. In addition, these through holes 122*a* may be configured and positioned such that they enable the view of at least one holding means 128 extending downwards from the bottom side of the support flange 122 or of the top side of the holding device 102 below the support flange 122, respectively. This facilitates correct insertion of the holding device 100 into the at least one recess in the carrier device 102.

The at least one holding means 128 may be embodied as a clip 130 with two resiliently flexible arms 130*a*. These two flexible arms 130*a* may be configured such that they contact each other in the initial state in at least one vertical location on the faces facing each other. At their underside, the two arms 130*a* may comprise ends 130*b* that are bent away from each other below the lowest contact point (when viewed in the vertical direction), such that an insertion region 130*c* is formed between the two ends 130*b*. As explained below, this insertion region 130*c* may serve to sleeve the clip 130 with the two arms 130*a* onto a vertical wall in one or more recesses in the top side of the carrier device 102. The clip 130 or the holding means 128 may, as described above, be made of a cold-resistant material that remains sufficiently flexible in the cold, for example of metal or of a cold-resistant, flexible plastic.

Figure 5:
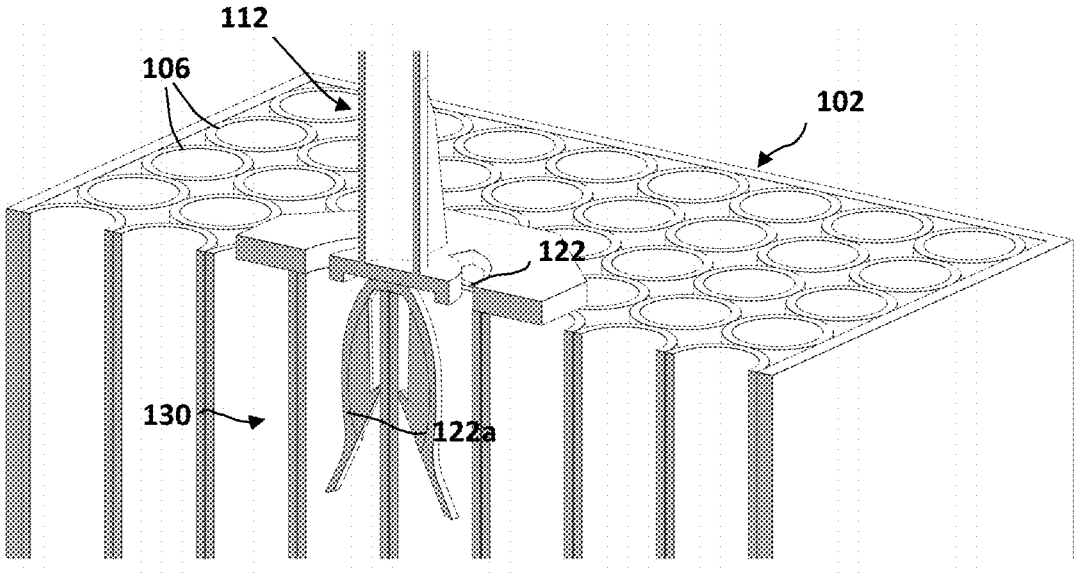
FIG. 5 shows a perspective longitudinal sectional view of the lower portion of the holding device of FIG. 1 engaged with the carrier device.

As can be seen in FIG. 5, an engagement part 112 of a holding device 100 configured in this way may be secured onto a carrier device 102 such that the two arms 130*a* of the clip 130 are sleeved onto two walls of two tubes 106, the walls facing each other, whereby a resilient force is applied onto the two tubes' 106 walls facing each other from the inner faces, facing each other, of the arms 130*a*. This resilient force is, of course, dependent on the force with which the two arms 130*a* facing each other are abutting against each other in the initial state (that is, without a wall there in-between), if a bias is present in the initial state. Of course, this is not necessarily required, but may be advantageous if the two walls of the tubes 106 only have relatively low overall thickness.

The holding means 128, in particular the clip 130, may also be formed such that both arms 130*a* only enclose a single wall of a tube 106 in the mounted state. For this purpose, the arms 130*a* may be dimensioned such that they are able to engage with corresponding gaps between two adjacent tubes 106.

The arms 130*a* may also be configured such that they do not abut against each other in the initial state, but rather are spaced apart with a predefined distance. In such a configuration, the arms 130*a* may engage with different tubes 106 or also with gaps between the tubes 106, whereby the distance between the arms 103*a* in the mounted state is not defined by two immediately adjacent walls (in contact with each other), but rather by the thickness of two walls and a distance therebetween.

The at least one holding means 128 may also be configured in another suitable manner to secure the holding device, in particular the engagement part 112, in a recess in the top side of the carrier device 102. For example, the at least one holding means 128 may also be configured as a conical extension or mandrel extending vertically downward, which engages with the circular cylindrical opening of a tube 106 of a carrier device 102, as illustrated in FIGS. 1 and 2. At least in a region immediately below the support flange 122, the mandrel may have an outer diameter substantially corresponding to the inner diameter of a tube 106.

Such an embodiment may be particularly advantageous, when the holding device 100 is sold together with a firework battery. The mandrel, in particular its outer diameter, may then be adapted to the respective inner diameter of the firework battery. After it has been burned, this firework battery may then be used together with the respective holding device to safely light further articles of fireworks.

By means of all variants of the holding means 128 described above, if configured and dimensioned appropriately, it can be ensured that the support flange 122 rests with its bottom side on the top side of the holding device and that the engagement part 112 and/or the entire holding device 100, respectively, is secured against toppling over or inadvertent release from the carrier device 102.

Figure 6:
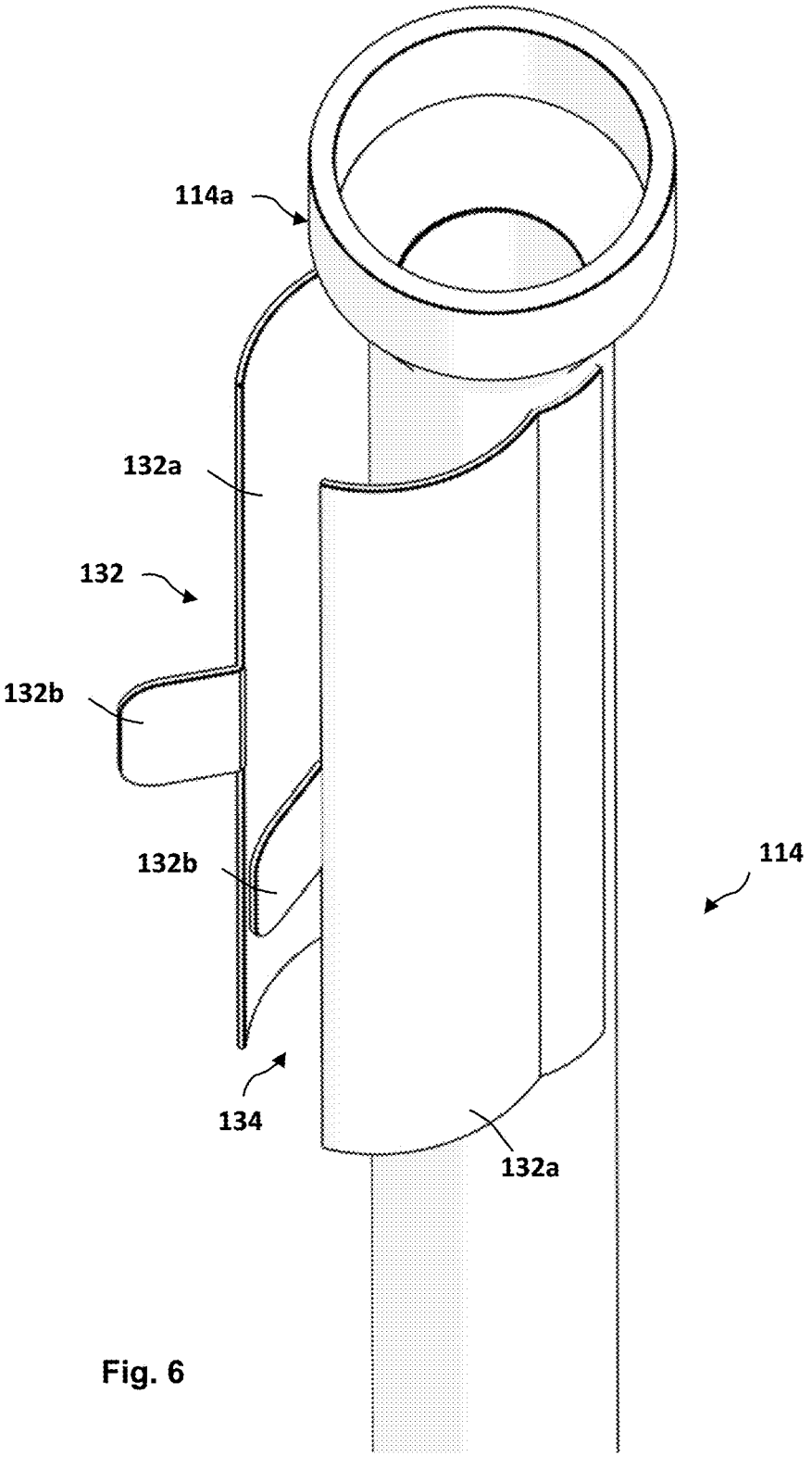
FIG. 6 shows an enlarged partial view of the upper portion of the holding device of FIG. 3.

FIG. 6 shows an enlarged perspective view of an upper region of a top part 114 of the holding device 100 of FIGS. 1 and 2. In this representation, in particular the upwardly widening portion 114*a* of the top part 114 as well as the windscreen means 132 are clearly visible.

The top part is configured as a hollow cylinder in this embodiment of a holding device 100, as also shown in FIGS. 1 and 2. This enables the guide stick of a skyrocket 118 to engage with the top part and, where applicable, with the connecting part 116 underneath, which is also configured as a hollow cylinder. As explained below, however, the latter is not absolutely necessary. Rather, the top part 114 may also be configured such that in the mounted state, its longitudinal axis is not aligned with the longitudinal axis of the connecting part 116. In this case, the guide stick of the skyrocket 118 only engages with the top part 114 and is located below the top part 114 outside of the connecting part 116. In this case, the connecting part 116 may also be embodied in solid form. The upper region of the top part 114 comprises the portion 114*a* that widens compared to the region of the top part 114 located underneath. The portion 114*a* may comprise a steadily widening, for example conical, region immediately above the region of the top part 114 located underneath with, for example, a constant cross section. In its uppermost region, the portion 114*a* may once again have a constant cross section. However, the steadily widening portion may also extend to the upper end of the top part 114.

All of these embodiments offer the advantage that, as shown in FIG. 2, in its lower region, the fuse of a skyrocket 118 does not abut against the outer wall of the top part 114 (in a region below portion 114*a*). This facilitates, on one hand, the lighting of the fuse and, on the other hand, avoids damage to the outer wall of the top part 114 when the fuse is burning.

The windscreen means 132 may, as can be seen from FIG. 6, comprise two vane-like walls 132*a* extending outward from the outer wall of the top part 114. These walls 132*a* enclose a space between them, with which the fuse of a skyrocket 118 engages after insertion of the skyrocket 118. The outer end regions of the walls 132*a* that are located the farthest away from the outer wall of the top part 114 may only leave a small gap 134 between them in the unfolded operative state of the vane-like walls 132*a*, the gap being selected just large enough that one is able to reach the fuse with an igniter, for example a match or a lighter (at least with the flame produced therewith), through the gap 134.

The walls 132*a* may be made of a flame resistant material, for example of a fireproof plastic or of metal, for example a metal film. The walls 132*a* may be attached with a vertical portion to the outer wall of the top part 114 below the widening portion 114*a*, for example by gluing. In an initial state (state at the time of sale), the walls 132*a* may rest on the outer periphery of the top part 114. In this initial state, the walls 132*a* may also overlap. For the transition to the operative state, the walls 132*a* may be pivoted or bent outwards, respectively, until a suitably large gap 134 is present between the outer regions of the walls 132*a*. To this end, the walls 132*a* may comprise centered tabs 132*b*, for example. The tabs 132*b* may be grasped for unfolding the walls 132*a* from the initial state and pulled outward in a substantially radial direction with respect to the longitudinal axis of the top part 114.

The inner sides of the windscreen vanes and/or the peripheral surface of the outer wall of the top part 114 therebetween (or the receiving part 240 in case of the second embodiment described below) may have a bright (for example, white or yellow) surface. This allows better visibility of the fuse in a dark environment. The corresponding surfaces may, for example, be luminescent.

Figure 7:
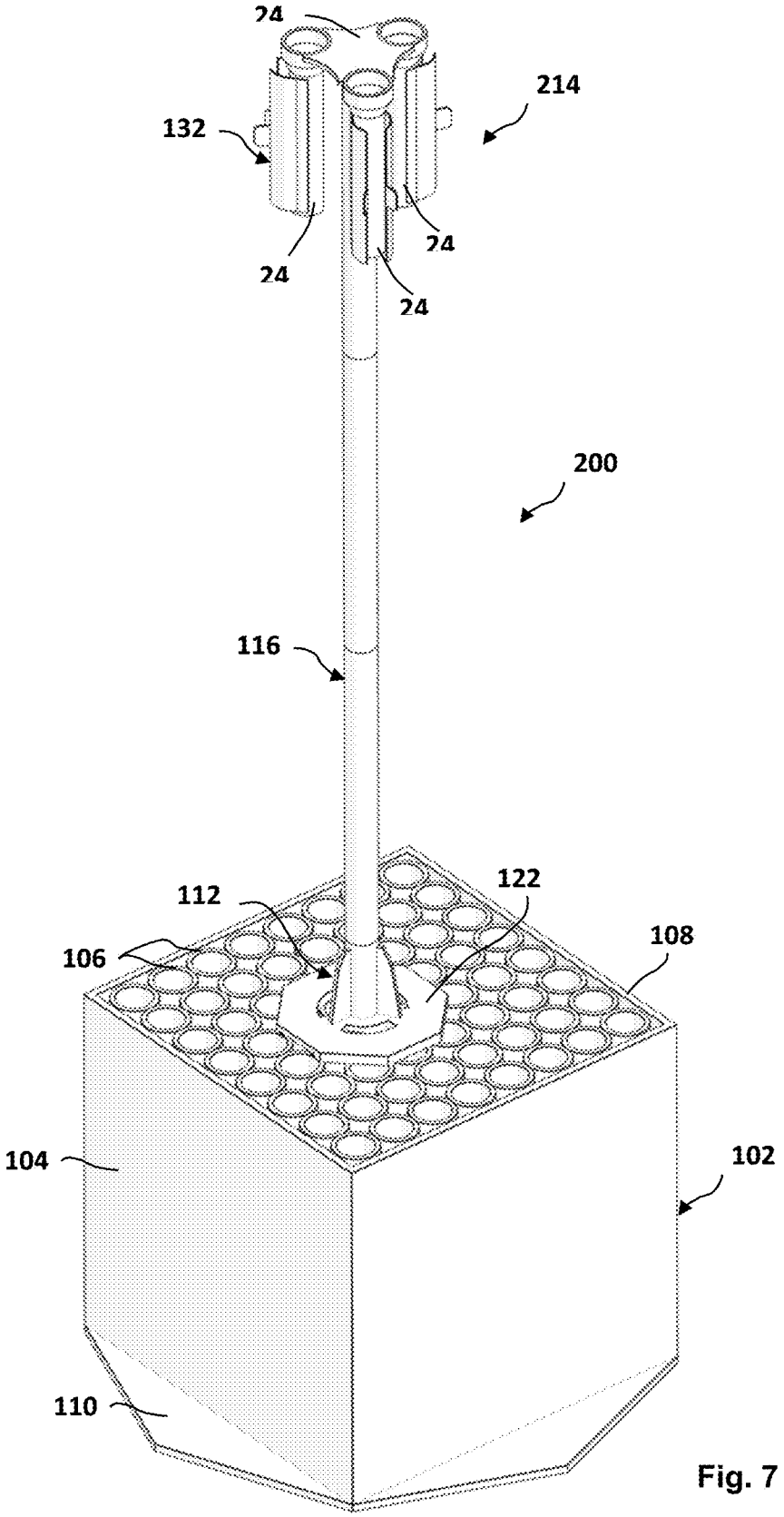
FIG. 7 shows a perspective view of a second embodiment of a holding device inserted into a carrier device according to the invention.

FIG. 7 shows another embodiment of a holding device 200 in a state attached to a carrier device 102. The holding device 200 differs from the embodiment shown in FIGS. 1-3 and 6 merely in that a differently configured top part 214 is provided. For this reason, for the following description and in FIGS. 7-9, the same reference numerals will be used for components and elements that are identical to the previously described embodiment. Since the mounting and securing of the holding device 200 of this further embodiment is identical to the mounting and securing of the holding device 100 of the previously described embodiment as well as the corresponding parts and components, respectively, the following description of the holding device 200 may be limited to the description of the top part 214.

As can be seen from FIG. 7, the top part 214 is configured such that three skyrockets may be held therein for setting them off. For this purpose, the top part 214 comprises a receptacle for skyrockets 120, whereby a tubular receiving part 240 is provided for each skyrocket 120 to be received. In principle, each of the tubular receiving parts 240 is configured like the top part 114 of the embodiment of the holding device 100 described above for a single skyrocket 120. This also applies to the provisioning of windscreen means 132 at each of the receiving parts 240.

The tubular receiving parts 240 are interconnected via a head plate 242 of the top part 214. The tubular receiving parts 240 extend (when viewed in the assembled state) vertically from the head plate 242 downwards.

Figure 8:
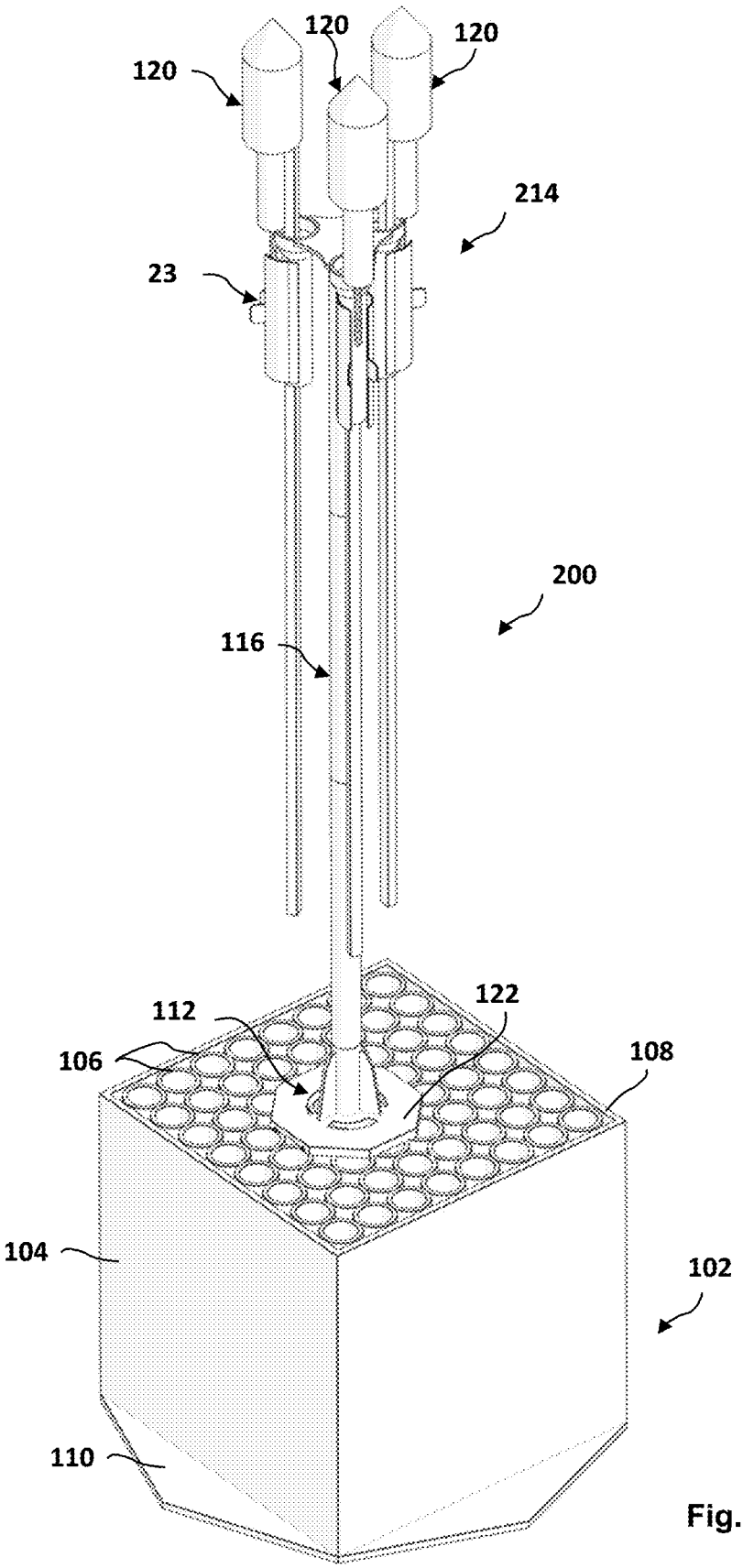
FIG. 8 shows a view as in FIG. 7, but with three skyrockets inserted into the holding device.

As shown in FIG. 8, the top part 214 is dimensioned such that the longitudinal axes of the tubular receiving parts 240 have sufficient spacing to ensure that the inserted skyrockets 120 do not interfere with each other when lighting them, that is, in particular do not contact each other when inserted into the holding device 200.

Each receiving part 240 may have a widening portion in its upper region, as previously described for the holding device 100. Likewise, each receiving part 240 may also comprise the windscreen means 132 described above.

Figure 9:
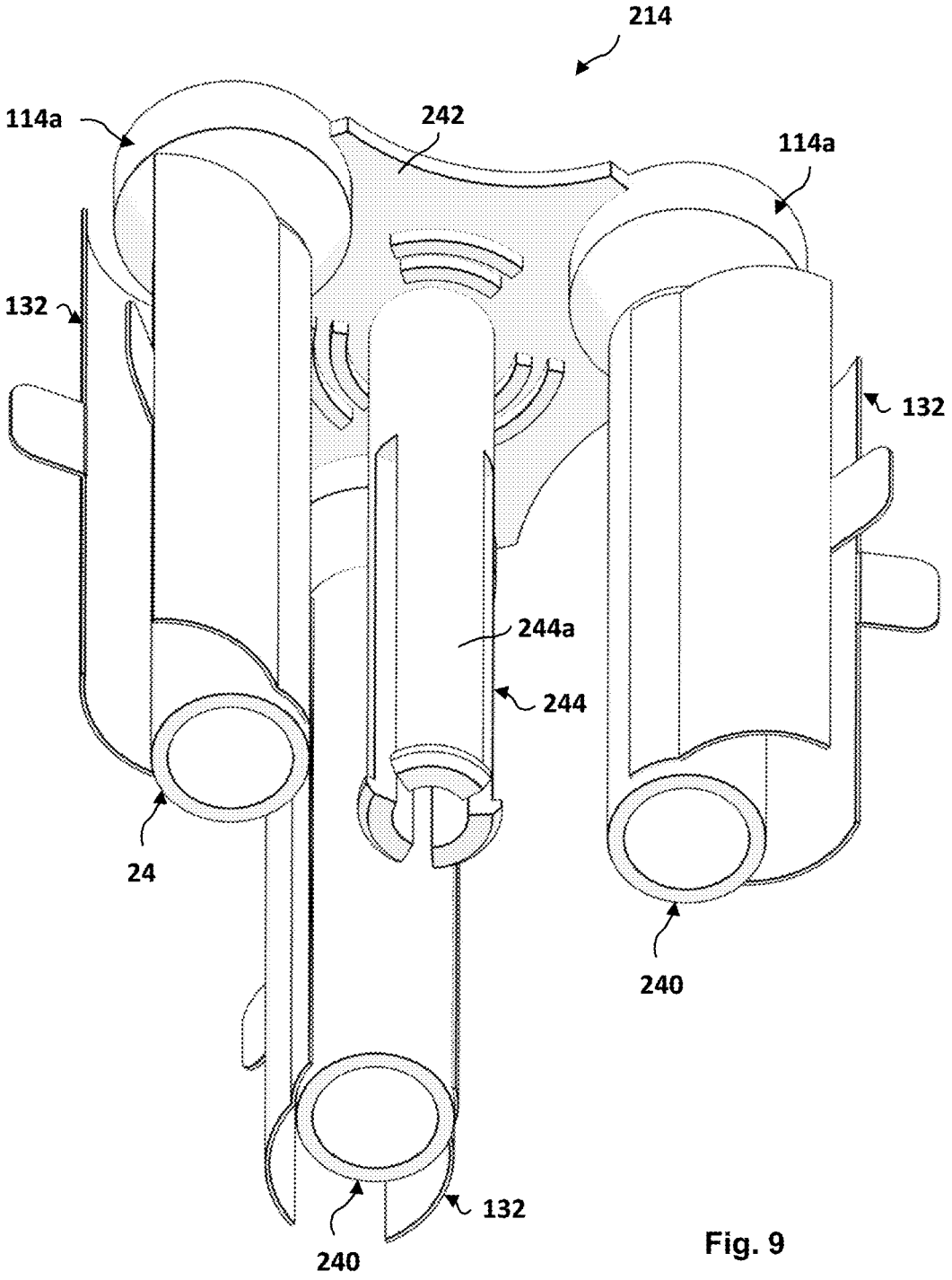
FIG. 9 shows a perspective view of the disassembled top part of the second embodiment of the carrier device according to the invention.

FIG. 9 shows the top part 214 in the disassembled state. As can be seen from this figure, the top part 214 may comprise an engagement part 244 extending vertically downward from the head plate 242 and engaging with a correspondingly configured connecting part 116 from above. As shown in FIG. 9, the engagement part 244 may be configured substantially as a hollow cylinder element, which is protected in its lower region, creating at least two, three in the illustrated example embodiment shown, resilient walls 244*a*. At the lower end of the engagement part 244 snap-lock means 246 may be provided that interact with complementary snap-lock means in a correspondingly hollow cylindrical connecting part 116 (or a portion thereof), such that an inadvertent extraction of the engagement part 244 or the top part 214 from the connecting part 116 is avoided.

Of course, it is possible to provide any other number of receiving parts 240 for the top part 214 instead of three receiving parts 240. It is also possible to provide, instead of the engagement part 244, a further receiving part 240 configured, as in the first embodiment, to receive the guide stick of a skyrocket and connected to the connecting part 116 in its lower region, whereby the guide stick also engages with the connecting part.

Alternatively or additionally, in an additional embodiment, not shown, the top part may be configured for setting off different types of articles of fireworks. For example, a head plate (such as in the second embodiment of FIGS. 7 to 9) may be provided, where a central, upwardly extending extension or mandrel is provided instead of (or in addition to) the receiving parts 240. It may be configured and dimensioned such that it serves as a mount for setting off a pyrotechnic pinwheel, which may rotate about the extension when burning. As described above with regard to the engagement part, upwardly extending holding means for a bomb tube may also be provided on such a head plate. These holding means for a pyrotechnic pinwheel or a bomb tube may be provided in addition to the receiving parts 240 for skyrockets, for example in the center between the receiving parts 240.

In the first embodiment described above, the engagement part 112 with the extension 124 extending upward may also serve to secure a bomb tube or any other article of firework, when a corresponding recess is provided at its underside, with which the extension 124 may engage.

In general, the holding device ensures a start or launch angle of substantially 90° with respect to Earth's horizon, as specified by the manufacturers of articles of fireworks shot into the air. The device acts as a tilt protection. It is dimensioned such that tilting or bending by the forces that occur when lighting the corresponding articles of fireworks is avoided, even at higher wind loads.

The clip of the engagement part 112 described above may comprise interconnected arms 130*a* in an initial state (before first use). For example, the arms 130*a* may be connected via a link or a small plate that may have a predetermined breaking point. When attaching the engagement part 112 with the clip 130 onto the carrier device 102 (in particular a firework battery), the link or small plate must be disconnected. The holding device reaches its desired end position only after separation of this tangible resistance. The link or the small plate may be configured such that during separation, a sound is generated in addition to the tangible resistance, signaling the operator that the holding device (after the last minor distance to the stop of the support flange 122) is connected securely and correctly to the carrier device.

It is also possible to provide the holding device with a linkage that may be configured above the top side of the support flange 122. This allows varying the firing angle. The linkage may also be configured or arranged such that it enables a rotation of the part of the holding device located above. Thereby, the articles of fireworks may be launched in different directions. Furthermore, this allows compensating gradients of the surface on which the carrier device 102 is located.

LIST OF REFERENCE NUMERALS

100 holding device
102 carrier device
104 base body
106 tubes
108 outer wall
110 bottom wall
112 engagement part
114 top part
114*a* widening portion
116 connecting part
116*a* cylindrical part
116*b* cylindrical part
118 article of firework
120 skyrocket
120*a* head (skyrocket)
122 support flange
124 extension
126 reinforcement
128 holding means
130 clip
130*a* flexible arm
130*b* end
130*c* insertion region
132 windscreen means
132*b* tab
132*a* wall
134 gap
200 holding device
214 top part
240 receiving part
242 head plate
244 engagement part

The invention claimed is:

1. A holding device for fireworks, the holding device:

(a) comprising an engagement part (112);

(b) wherein at least one of the engagement part (112) and a top part (114) connectable or connected thereto is configured to receive a firework (118) to be set off; and (c) wherein the engagement part (112) is configured to mount the holding device to a top surface of a carrier device (102);

characterized in that:

(d) the carrier device (102) comprises a plurality of parallel, interconnected, vertically oriented tubes (106) comprising end faces which form a top surface of the carrier device (102);

(e) the engagement part (112) comprises a support flange (122) for resting on the top side of the carrier device (102) in a mounted state of the holding device on the carrier device (102), wherein at least one mount (128) is provided on a bottom side of the support flange (122), said at least one mount being configured to engage with at least one recess in the top surface of the carrier device (102); and (f) the at least one mount (128) being configured in a clip-like manner;

wherein the carrier device (102) is a base body (104) of a burned-out firework battery.

2. The holding device according to claim 1, characterized in that the at least one mount comprises at least one clip (130) having two resiliently flexible arms (130*a*) abutting against a respective inner wall of the at least one recess in the mounted state and applying a force thereto, wherein the two force vectors have components directed in opposite directions.

3. The holding device according to claim 1, characterized in that the at least one mount (128) is configured to engage with two immediately adjacent tubes (106) of the carrier device (102).

4. The holding device according to claim 2, characterized in that the two resiliently flexible arms (130*a*) of the at least one mount (128) are configured as a clip (130) configured to apply a force onto inner walls facing each other of two immediately adjacent tubes (106) of the carrier device (102).

5. The holding device according to claim 1 characterized in that the engagement part (112) comprises a receptacle for the firework to be set off.

6. The holding device according to claim 1, characterized in that the top part (114) is releasably connected to the engagement part (112) or is connectable to the engagement part (112) without tools, or wherein the top part (114) and the engagement part (112) are releasably connectable by means of a connecting part (116) without tools.

7. The holding device according to claim 6, characterized in that the top part comprises a receptacle configured to receive at least one skyrocket.

8. The holding device according to claim 7 further comprising a skyrocket (120), and wherein, the receptacle configured to receive the skyrocket (120) comprises a tubular receiving part (240) for a guide stick of the skyrocket (120), wherein the tubular receiving part (240) has an inner cross section such that a top part of the skyrocket (120) abuts against an upper end face of the tubular receiving part (240) in the inserted state of the skyrocket (120) into the tubular receiving part.

9. The holding device according to claim 8, characterized in that the tubular receiving part (240) has an upwardly, conically, widening shape, wherein the conical widening (114*a*) is dimensioned such that the upper end of the wall of the tubular receiving part (240) prevents a fuse of an inserted skyrocket (120) from abutting against an outer wall of the tubular receiving part (240).

10. The holding device according to claim 8, characterized in that a windscreen (132) is provided on an outer wall of the tubular receiving part (240) so as to create a windscreened region, where a fuse of a skyrocket (120) inserted into the tubular receiving part (240) engages.

11. The holding device according to claim 10, characterized in that the windscreen (132) comprises one or two walls (132*a*) that are pivotable about a vertical axis.

12. The holding device according to claim 1, characterized in that the engagement part (112) comprises a receptacle for one selected from the group consisting of a bomb tube and a pyrotechnic pinwheel.

* * * * *